United States Patent [19]

LeBegue

[11] 4,225,189

[45] Sep. 30, 1980

[54] CONTINUOUS MINING MACHINE AND CUTTER DRUM DRIVE THEREFOR

[75] Inventor: Maurice K. LeBegue, Argillite, Ky.

[73] Assignee: National Mine Service Company, Pittsburgh, Pa.

[21] Appl. No.: 962,080

[22] Filed: Nov. 20, 1978

[51] Int. Cl.[2] ..... E21C 25/08

[52] U.S. Cl. ..... 299/71; 299/78; 299/89

[58] Field of Search ..... 299/89, 76, 78, 64, 299/75, 80, 71

[56] References Cited

U.S. PATENT DOCUMENTS

| | | | |
|---|---|---|---|
| 356,699 | 1/1887 | Stire | 299/89 |
| 571,259 | 11/1896 | Boland et al. | 299/89 |
| 594,896 | 12/1897 | Palmer | 299/89 |
| 2,758,826 | 8/1956 | Paget | 299/78 |
| 3,101,932 | 8/1963 | Wright | 299/89 |
| 3,290,096 | 12/1966 | Stalker | 299/78 |
| 3,307,880 | 3/1967 | Newton et al. | 299/75 |
| 3,774,696 | 11/1973 | LeBegue | 299/76 |
| 3,848,930 | 11/1974 | LeBegue | 299/89 |
| 3,986,995 | 7/1976 | Aventzen | 299/76 |

*Primary Examiner*—William F. Pate, III

*Attorney, Agent, or Firm*—Stanley J. Price, Jr.; John M. Adams

[57] ABSTRACT

A cutter drum member of a continuous mining machine is rotatably mounted on the front end of the machine. The drum member includes an intermediate section and a pair of canted end sections. Cutting elements extend from the surface of the respective drum sections and provide a continuous cutting pattern along the entire length of the drum member. Input drive shafts extend through rear openings between the adjacent ends of the intermediate section and the end sections. Rotation is transmitted from the input drive shafts through meshing bevel gears and planetary gears to rotate the intermediate section. The adjacent ends of the intermediate section and end sections include meshing gear teeth secured to the external surface of the sections so that the canted end sections are driven by the external meshing gear teeth. Passageways formed between the gear teeth on the external cylindrical surfaces of the drum sections facilitate the flow of dislodged material between the gear teeth to prevent material from accumulating between the teeth and thereby ensure positive drive to the canted end sections.

8 Claims, 4 Drawing Figures

CONTINUOUS MINING MACHINE AND CUTTER DRUM DRIVE THEREFOR

BACKGROUND OF THE INVENTION

1. Field of the Invention

This invention relates to a continuous mining machine and more particularly to the drive mechanism for rotating the intermediate section and the end sections of the cutter drum member.

2. Description of the Prior Art

Mining machines having a full face drum that is arranged to dislodge material from a mine face without transverse oscillating movement of the drum are known and disclosed in U.S. Pat. Nos. 2,721,733; 3,109,636; and 3,305,273. The support means and drive means for the drum include fixed annular end portions of the boom member extending around the external surface of the drum as illustrated in U.S. Pat. No. 3,305,273. Endless chain elements with cutter bits mounted thereon extend around the support means to dislodge material from the face along the width of the annular end portions of the supporting boom.

U.S. Pat. No. 3,774,969 discloses a mining machine with a drum member rotatably supported by annular end portions of a boom member. The drum member has an intermediate section and canted end sections with rear openings between the inner ends of the end sections and the outer ends of the intermediate section. Input shafts extend through these openings and have drive pinions meshing with bevel gears rotatably supported within the drum member intermediate section. The bevel gears are splined to shafts with sun gears of planetary gear trains nonrotatably mounted thereon. The planet cages are secured to the intermediate drum section and rotate as the planet gears revolve around the respective sun gears. The planet cages are also connected through universal joints to the adjacent drum canted end portions.

The above planetary drive is suitable for drum-type mining machines in which the drum has a sufficient diameter to accommodate the above discussed planetary gearing and the gearing has sufficient size and strength to withstand the stresses encountered during the mining operation. In smaller mining machines suitable for mining thin seams of material, the diameter of the drum and consequently, the space available within the drum substantially limit the size of the drive gearing.

U.S. Pat. No. 3,848,930 discloses a mining machine cutter drum drive in which pinion gears of drive shafts mesh with bevel gears to rotate the drum member intermediate section. The bevel gears are drivingly connected to the adjacent end sections in one embodiment by a universal drive connection and in another embodiment by bevel gears nonrotatably connected to the end sections. Also it is disclosed to utilize bevel gears of reduced diameter to accommodate cutter drums for mining thin seams of material.

The U.S. Pat. No. 3,101,932 discloses a mining machine having a universal connection between the canted end sections of the drum. U.S. Pat. No. 2,758,826 discloses cutter head sections driven by a main bevel gear meshing with a spur gear train that includes a pair of bevel gears. Drive arrangements for the cutting head of a mining machine are also illustrated and described in U.S. Pat. Nos. 3,290,096 and 3,307,880.

There is need in a drum-type continuous mining machine for a drive arrangement for rotating the drum member intermediate section and the end sections in which the drive arrangement overcomes the problems encountered in smaller mining machines for mining thin seams of material where the space within the cavities of the respective drum sections is limited for complex gear mechanisms. Also, there is need in standard size mining machines for a cutter drum drive operable to withstand the stresses encountered during the mining operation with a minimum amount of maintenance and replacement of drive components.

SUMMARY OF THE INVENTION

In accordance with the present invention there is provided a continuous mining machine that includes an elongated body portion mounted on propelling devices. A drum member is rotatably mounted forwardly of the body portion. The drum member has cutting elements extending therefrom. The drum member has an intermediate section and a pair of end sections. The end sections extend angularly to the intermediate section so that certain of the cutting elements mounted on the drum member overlap along the front of the drum member to provide a continuous cutting pattern along the front of the drum member. The drum member intermediate section and at least one of the pair of drum member end sections forms an opening therebetween. An input drive mechanism extends through the opening for rotating the drum member intermediate section. Meshing gear devices nonrotatably secured externally to the drum member intermediate section and to one of the pair of drum member end sections respectively transmit rotation of the input drive mechanism from the drum member intermediate section to one of the pair of end sections.

The meshing gear devices include a first set of gears and a second set of gears. The first set of gears include a plurality of gear teeth secured to the end of the drum member intermediate section adjacent at least one of the pair of drum member end sections. The gear teeth of the first set of gears are positioned in spaced relation around the periphery of the drum member intermediate section to form openings or passgeways between the individual gear teeth on the surface of the intermediate section. The second set of gears includes a plurality of individual gear teeth secured to at least one of the pair of drum member end sections adjacent the gear teeth on the end of the drum member intermediate section. The gears of the second set are positioned in spaced relation around the periphery of the end section opposite the passageways between the gear teeth of the first set of gears. The gear teeth of the second set mesh with the gear teeth of the first set so that rotation of the drum member intermediate section is transmitted to the respective drum member end section.

Preferably, the gear teeth of the first set of gears are secured as by welding to the periphery of the drum member intermediate section adjacent the outer annular edge portion of the intermediate section. The gear teeth project outwardly toward the respective drum member end section. The gear teeth extend outwardly from the cylindrical surfaces of the respective drum member sections so that the solid material dislodged from the mine face does not accumulate between adjacent teeth and flows freely over the cylindrical surface of the drum member sections between the gear teeth.

With this arrangement a meshing relationship of gear teeth is provided without conventional roots between gear teeth, thus avoiding the problem of dislodged material accumulating between gear teeth and interfering with the transfer of drive to the canted end section. However, the provision of the convex surfaces separating gear teeth on the surface of the drum member sections maintains flow of dislodged material between the gear teeth and outwardly from the cylindrical surfaces of the drum member.

Accordingly, the principle object of the present invention is to provide for a continuous mining machine having a drive arrangement of external meshing gears drivingly connecting the drum member intermediate section to at least one of the pair of drum member end sections for transmitting rotation from the intermediate section to the respective end section.

Another object of the present invention is to provide for a continuous mining machine, a drive mechanism for rotating the drum member intermediate section and transmitting rotation therefrom to a pair of drum member canted end sections by gear teeth secured externally to the adjacent end portions of the drum member sections and arranged in meshing relation.

A further object of the present invention is to provide drive for the cutter drum of a continuous mining machine by transmission of rotation to the intermediate section of the drum member and therefrom to the pair of drum member canted end sections by meshing gears secured externally to the adjacent end portions of the drum member sections in which the solid material is permitted to pass freely between the gears and thereby maintain continuous drive transfer to the pair of end sections.

These and other objects of the present invention will be more completely disclosed and described in the following specification, the accompanying drawings and the appended claims.

DESCRIPTION OF THE PREFERRED EMBODIMENT

Figure 1:
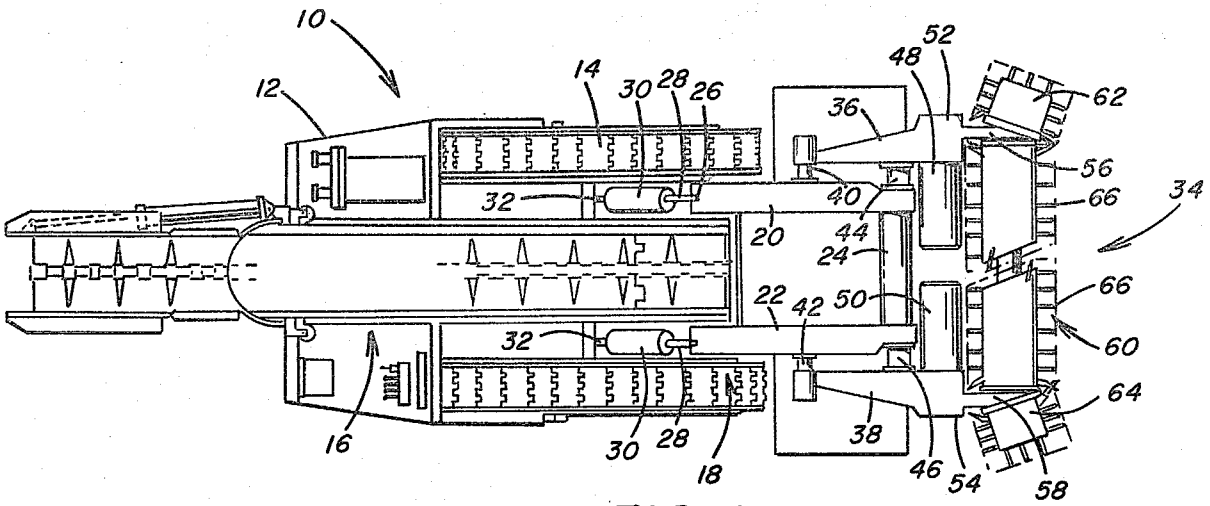
FIG. 1 is a schematic top plan view of a continuous mining machine, illustrating an intermediate drum section drivingly connected by external meshing gears to a pair of end sections.

Referring to the drawings and particularly to FIG. 1 there is illustrated a continuous mining machine generally designated by the numeral 10 that has a body or frame portion 12 suitably mounted on endless crawler tracks 14. Suitable drive means are provided to propel the mining machine 10 on the endless crawler tracks 14 to advance the mining machine during the mining operation. An endless conveyor mechanism generally designated by the numeral 16 is positioned in a longitudinal trough member and is arranged to convey dislodged material from the front of the mining machine to a receiver positioned rearwardly of the mining machine. A suitable gathering device is provided for gathering the dislodged material and feeding the dislodged material onto the conveyor 16 so that the material can be conveyed rearwardly thereon.

A forwardly extending boom member generally designated by the numeral 18 has a pair of parallel rearwardly extending arm members 20 and 22 that are connected to each other adjacent the front end portion by a transverse housing 24. The arm members 20 and 22 are pivotally connected to the mining machine body portion 12 and are also pivotally connected at 26 to piston rods 28 of piston cylinder assemblies 30. The piston cylinder assemblies 30 are, in turn, pivotally connected to the mining machine body portion 12 at 32 so that the piston cylinder assemblies 30 are arranged to pivot the boom member 18 about the respective end portions of the arm members 20 and 22 to move the boom member 18 vertically for an upward or downward shear cut of the mine face by the drum member generally designated by the numeral 34.

The boom member 18 has a second pair of parallel arm or support members 36 and 38 that are supported adjacent their rear end portions by stabilizer rods 40 and 42. The stabilizer rods 40 and 42 have a generally cylindrical configuration and extend through suitable cylindrical passageways in the respective arm members 36 and 38.

The transverse housing 24 that supports the ends of the boom member arms 20 and 22 in spaced parallel relation to each other has a cylinder therein when piston rods 44 and 46 extending outwardly therefrom. The piston rods 44 and 46 are secured at one end to the respective boom arm members 36 and 38 and to the pistons within the cylinder in the transverse housing 24. Suitable means may be provided, as is described in U.S. Pat. No. 3,774,969, which is incorporated herein by reference, to move the piston rods 44 and 46 outwardly to extend the intermediate section of the drum during the mining operation. Where the intermediate section of the drum is unitary so that the drum has a fixed longitudinal dimension, the rods 44 and 46 may be similar to the rods 40 and 42 to support the boom arms 36 and 38 from the transverse housing 24. However, it should be understood that the scope of the present invention does not pertain to the extensibility of the drum member 34 and a nonextensible drum member having a fixed length may also be utilized with the present invention.

Drum rotating motors 48 and 50 are secured to the laterally movable support members 36 and 38 and are preferably positioned therebetween. The motors 48 and 50 may be either electrical or hydraulic motors that are arranged to rotate the drum member 34. The drum member 34 is supported from the housings 52 and 54 which form a part of the boom support members 36 and 38. Suitable clutch mechanisms are included within the housings 52 and 54 to connect drive means, to be explained later in greater detail, that extend through the housings to the gearing within the drum member 34 to rotate the drum member 34 to dislodge material from the mine face.

Figure 4:
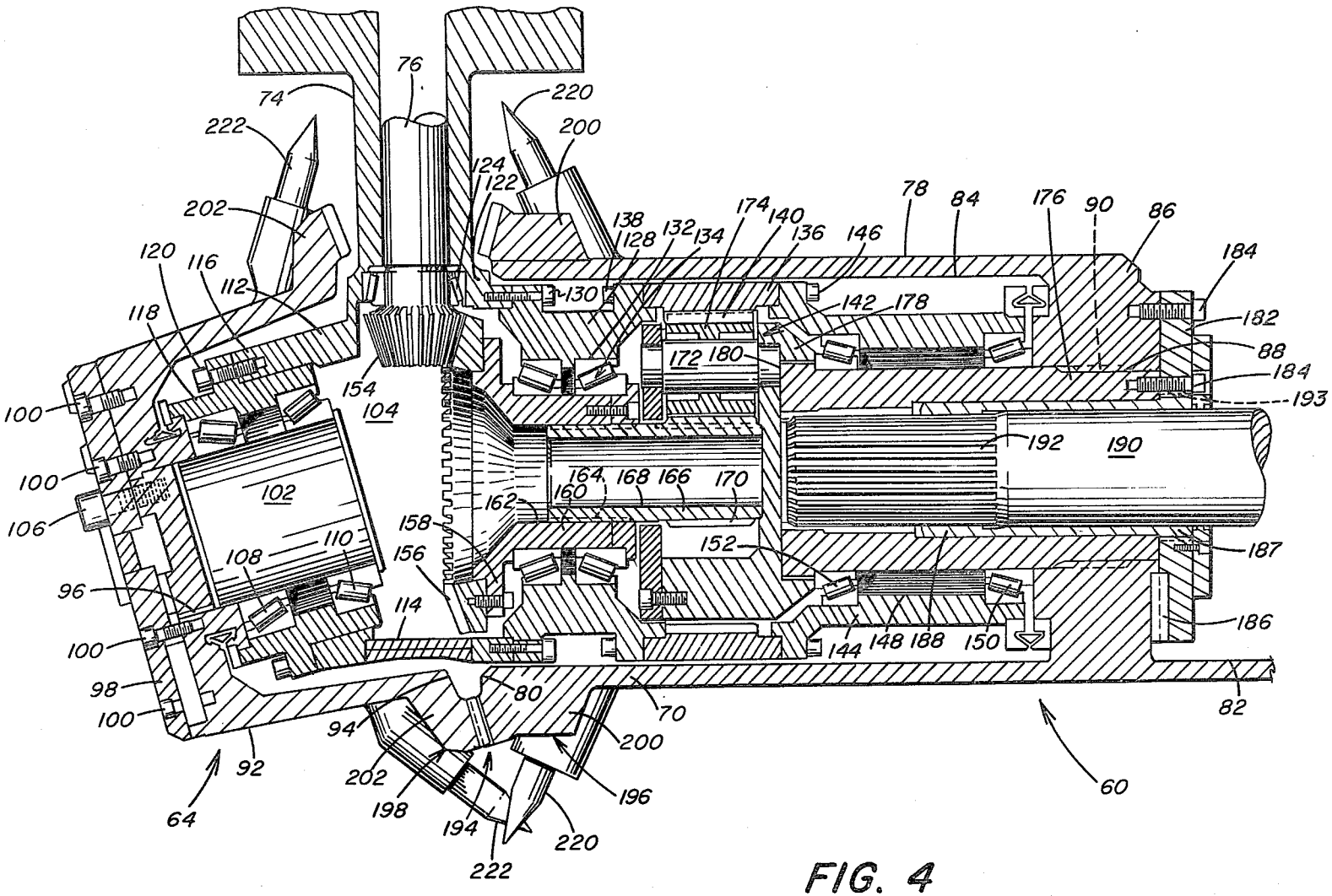
FIG. 4 is a sectional view of the drive connection between the drum member intermediate section and one of the drum member canted end sections, illustrating the external arrangement of meshing gears on the respective sections for transmitting rotation from the intermediate section to the end section.

The boom support members 36 and 38 have forwardly extending annular portions 56 and 58 that extend through openings in the drum member 34 to rotatably support the drum member 34. This arrangement is more completely illustrated in FIG. 4. The drum member 34 illustrated in FIG. 1 has a laterally extensible intermediate section generally designated by the numeral 60 and a pair of canted or angularly arranged end sections 62 and 64. The intermediate section 60 has a generally cylindrical configuration and has cutter bits 66 extending radially therefrom. As illustrated in FIG. 4, the intermediate section 60 has a row of cutter bits adjacent end portion 70 of the intermediate section 60. The row of cutter bits extend over the boom member annular portion 58. Similarly, the canted end sections 62 and 64 have cutter bits that extend inwardly in overlapping relation with the row of cutter bits of the intermediate section 60. The drum member end sections 62 and 64 have a generally cylindrical configuration as illustrated in FIGS. 1 and 4 but may alternately have the configuration of a segment of a cone.

Referring to FIG. 4, there is illustrated in detail the drive gearing for the drum member intermediate section 60 and the end section 64. It should be understood that the drive gearing for the other end section 62 is similar to that for the end section 64 illustrated in FIG. 4, and the description will be confined to the drive means for the drum member intermediate section 60 and end section 64.

As illustrated in FIG. 4, the boom member 18 has a tubular intermediate portion 74 through which a drive shaft 76 extends into the drum member 34. The drum member intermediate section 60 has a cylindrical body portion 78 with an outer bit supporting wall. The body portion 78 has an outer annular edge 80 and an inner annular edge 82 and an internal cavity 84. The body portion 78 has an inwardly extending cylindrical supporting section 86 with an axial passageway 88 therein. The passageway 88 has an inner cylindrical wall with a splined portion 90.

The drum member end section 64 has a body portion 92 with an outer bit supporting wall and a generally cup-shaped configuration with an inner annular edge portion 94 and an opening 96 in the body portion 92. A circular cap member 98 overlies the opening 96 and is secured to the body portion 92 by bolts 100. A shaft member 102 is axially positioned in the opening 96 within a cavity 104 of the drum member end section 64. The shaft 102 is secured to the cap member 98 by bolts 106. The shaft 102 is rotatably mounted on roller bearings 108 and 110 within the cavity 104.

The tubular intermediate portion 74 has an annular front end portion 112 with an opening closed by an access plug 114. The end portion 112 has an angularly extending flange 116 that extends into the cavity 104 of body portion 92. A cylindrical support member 118 is positioned in overlying relation with the support flange 116 and is secured thereto by bolts 120 extending through the support member 118 and the support flange 116. The roller bearings 108 and 110 are mounted on the support member 118 so that the shaft 102 is rotatably supported within the support member 118 that is, in turn, secured to the flange 116 of the tubular intermediate portion 74.

The tubular intermediate portion 74 has an annular flange 122 positioned oppositely of the flange 116. The flanges 116 and 122 support roller bearing 124 which rotatably supports the drive shaft 76. An annular support member 128 is connected to the flange 122 by bolts 130. The annular support member 128 has an inner cylindrical wall 132 that supports a tapered roller bearing assembly generally designated by the numeral 134. A cylindrical member 136 is bolted to the end of the annular support member 128 by bolts 138. The cylindrical member 136 has internal gear teeth that form a ring gear 140 of a planetary gear arrangement generally designated by the numeral 142. Another annular support member 144 is secured to the opposite end of the cylindrical member 136 by bolts 146. The annular support member 144 has an inner cylindrical wall 148 that supports the roller bearings 150 and 152.

With the above described arrangement the front end portion 112 of the tubular portion 74 nonrotatably supports the drum member end section support member 118 and nonrotatably supports the intermediate drum support member 128. The drum support member 128 is, in turn, nonrotatably connected to the cylindrical member 136 and the annular support member 144. Accordingly, this structure rotatably supports the drum member intermediate section body portion 78 and the drum member end section body portion 92.

The respective drum member body portions 78 and 92 are rotated by a drive arrangement that includes a bevel pinion 154 connected to the end portion of the drive shaft 76 extending into the opening between the intermediate section 60 and the end section 64. A bevel gear 156 meshes with the bevel pinion 154 and is secured to a radial flange 158 on a tubular shaft 160. The tubular shaft 160 is rotatably supported by the bearing assembly 134. The tubular shaft 160 has an inner wall 162 with a splined portion 164. A sun gear 166 has an axial bore 168 therethrough and a tubular shaft portion 170 extending laterally therefrom. The sun gear 166 is connected to the splined portion 164 of the tubular shaft 160. Thus, rotation of the bevel pinion 154 on drive shaft 76 rotates the meshing bevel gear 156 which, in turn, rotates the sun gear 166 through the splined portion 164.

The planetary gear arrangement 142 includes a plurality of planet gear support shafts 172 mounted with planet gears 174 positioned thereon. The planet gears 174 mesh with the sun gear 166 and the ring gear 140 so that rotation of the sun gear 166 revolves the planet gears 174 on the fixed ring gear 140. The plantary gear arrangement 142 rotates about the axis of the sun gear 166, which axis is concentric with the axis of the drum member intermediate section 60.

An output shaft 176 is axially positioned within the cavity 84 of the drum member intermediate section 60 and has a flanged end portion 178 with a splined connection 180 splined to the planetary gear arrangement 142. The opposite end portion of the output shaft 176 is connected by the splined portion 90 to the cylindrical supporting portion 86 and to an annular cap member 182 by bolts 184. The annular cap member 182 is connected by a bolt 184 and key 186 to the cylindrical supporting portion 86. The output shaft 176 is supported by roller bearings 150 and 152 for rotation relative to the annular support member 144.

A tubular shaft 187 is positioned within the axial bore of the output shaft 176 and has an inwardly extending annular shoulder portion 188. An axial connecting shaft 190 extends through the axial bore of the tubular shaft 187 and has an outwardly splined end portion 192 that meshes with the splines of the tubular shaft shoulder portion 188. Tubular shaft 187 is also connected to the cap member 182 by spline connection 193. With this arrangement the drum member intermediate section 60 and the drum member end section 64 are operable to move longitudinally relative to the connecting shaft 190 to permit extension and retraction of the drum member 34 without interfering with the drive train for the sections of the drum member.

With the above described arrangement rotation is transmitted from the drive shaft 76 to the drum member intermediate section 60. In accordance with the present invention rotation is transmitted from the intermediate section 60 to the end section 64 by an external meshing gear arrangement generally designated by the numeral 194, illustrated in FIG. 4. A similar arrangement is provided for transmitting drive from the intermediate section 60 to the opposite end section 62 which is illustrated in FIG. 1.

The external meshing gear arrangement 194 includes a first set 196 of gear-like members and a second set 198 of gear-like members. The first set 196 is suitably secured to the cylindrical surface of the intermediate section end portion 70 adjacent the outer annular edge 80. The second set 198 is suitably secured to the outer cylindrical surface of the inner end of the end section 64 adjacent the edge portion 94. The first and second sets 196 and 198 of gears are positioned on the respective drum member sections in meshing relation so that rotation of the first set 196 with the drum member intermediate section 60 transmits rotation to the second set 198 to rotate the drum member end section 64.

Each set 196 and 198 of gears includes a plurality of individual gear teeth. As for example, the first set 196 includes individual gear teeth 200 and the second set 198 includes individual gear teeth 202. A preselected number of individual gear teeth may be provided on each drum member section. In one embodiment of the present invention the gear teeth are arranged continuously around the respective sections where the gear teeth 200 are spaced from one another and the gear teeth 202 are spaced from one another. The gear teeth 200 extend between the spaces provided between the gear teeth 202, and the gear teeth 202 extend between the spaces provided between the gear teeth 200. In this manner the gear teeth are arranged in meshing relation so that rotation of the drum member intermediate section 60 is transmitted to the drum member end section 64.

As illustrated in FIG. 4, the drum member end section 64 is angularly positioned or canted relative to the drum member intermediate section 60; therefore, only the gear teeth of the first and second set 196 and 198 adjacent the outer annular edge 80 of drum section 60 and edge portion 90 of drum section 64 are in meshing relation. The remaining gear teeth vary in their relationship from partial meshing engagement to a completely disengaged relationship, as for example, the relationship between gear teeth 200 and gear teeth 202 positioned oppositely of the drive shaft 76. This permits the drive shaft 76 to extend between the first and second set 196 and 198 of gears into the internal cavities 84 and 104 of the respective drum member sections.

Figure 3:
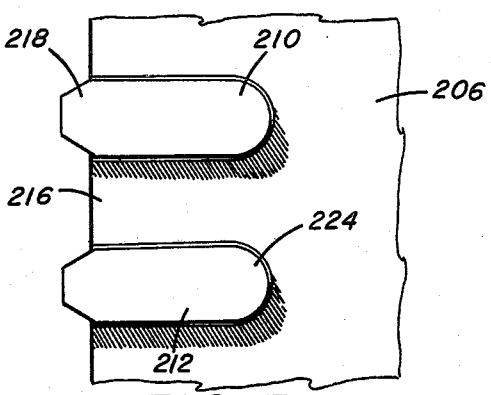
FIG. 3 is a fragmentary top plan view of the external gear teeth for the respective drum member sections.
Figure 2:
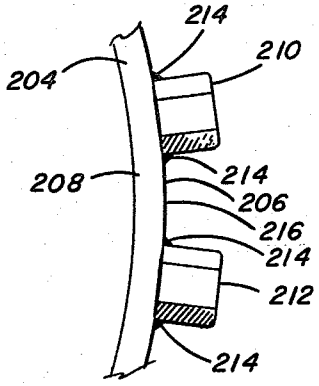
FIG. 2 is a fragmentary view in side elevation of a pair of gear teeth secured to an external cylindrical surface representing both the drum member intermediate section and end sections.

Referring to FIGS. 2 and 3 there is illustrated an example section of the drum member sections 60 and 64 having gear teeth secured to the external surface thereof. Each of the drum member sections 60 and 64 includes an outer cylindrical wall 204 having an exterior surface 206 and an interior surface 208 forming the interior cavity of each respective drum member sections. Further, the first and second set 196 and 198 of gears each includes a plurality of gear teeth, as for example the gear teeth 210 and 212 in FIGS. 2 and 3. Any number of gear teeth may be provided on the external cylindrical surface 206 of the respective drum member sections, and in one embodiment the gear teeth are continuous around the periphery of the respective drum sections. The gear teeth 210 and 212 are illustrative of the gear teeth provided on each drum member section 60 and 64 and are similar to the gear teeth 200 of the drum member intermediate section 60 and the gear teeth 202 of the drum member end section 64 illustrated in FIG. 4.

Each of the plurality of gear teeth 210 and 212 are suitably secured to the external surface 206 in a preselected manner, as for example by weldments 214 formed by welding the gear teeth to the external surface 206 of each drum member. The gear teeth 210 and 212 are positioned in spaced relationship to form longitudinal passageways 216 between adjacent teeth as illustrated in FIG. 3. The width of the longitudinal passageways 216 corresponds to the width of the respective gear teeth.

The gear teeth 200, as illustrated in FIG. 4, are positioned in spaced relation on the external surface of the drum member section 60 to extend outwardly into the passageways (not shown in FIG. 4) formed by the spaced gear teeth 202 on the drum member section 64. Accordingly, the teeth 202 of section 64 extend inwardly into the passageways (not shown in FIG. 4) formed between the adjacent teeth on the section 60. This arrangement provides a meshing relationship between the teeth 200 and 202, as illustrated in FIG. 4. Preferably, each of the gear teeth, as illustrated in FIGS. 2 and 3, have a beveled end portion 218 to facilitate engagement and disengagement of the teeth at the location of the meshing engagement adjacent the oppositely positioned edges 80 and 94 illustrated in FIG. 4.

Further, as illustrated in FIG. 4, the intermediate section 60 has a row of cutter bits 220 adjacent the intermediate section edge 80 the extends over the boom member annular end portion 58. Similarly, each of the canted end sections 62 and 64 have cutter bits 222 that extend inwardly toward the intermediate section 60 in overlapping relation with the cutter bits 220 adjacent the front of the drum member 34. This permits the drum member sections to dislodge material along the entire length of the drum member 34.

The cutter bits 220 on the intermediate section 60 are secured to the external surface of the drum member and positioned in alignment with the passageways 216 so as to accommodate the meshing of the gears 202 with the gears 200. Similarly, the cutter bits 222 are secured to the external surface of the respective end sections between the gear teeth 202 and the passageways 216 so as not to interfere with the meshing of the gears 200 with the gears 202.

The overlapping cutter bits 220 and 222 dislodge solid material from the mine face. With the above described arrangement of the gear teeth 210 and 212, as illustrated in FIGS. 2 and 3, the dislodged material is prevented from accumulating between the gear teeth and subsequently interfering with the meshing engagement of the gear teeth. This feature of the present invention is provided by the exclusion of a root structure between adjacent gear teeth as known with conventional gear structures. As illustrated in FIGS. 2 and 3, the passageways 216 provided between adjacent gear teeth, as for example between gear teeth 210 and 212, are operable to facilitate the free flow of dislodged material between the gear teeth.

The free flow of the dislodged material through the passageways 216 is promoted by the arcuate configuration of the cylindrical external surface 206 of each drum section. Material coming in contact with the arcuate surfaces 206 is urged to move away from the surfaces upon rotation of the drum sections. Consequently, dislodged material is prevented from accumulating in the passageways 206 and interfering with the engagement of the meshing gear teeth to the extent that the transmission of drive to the end sections would be interrupted. Thus, with this arrangement, there are no roots or cavities characteristic of conventional gear structure which would become clogged with dirt and mined material.

Thus, it will be apparent with the present invention that an improved drive arrangement is provided by the external meshing gear arrangement 194. With gear-like elements positioned externally on the drum sections, the limitations encountered with conventional internal gearing arrangements are overcome. This permits the utilization of relatively large gear teeth. Consequently, the drive gearing for the respective drum sections is not limited to the space available within the cavities of the drum sections. In addition, the external gear arrangement for rotating the end sections permits the use of larger gear elements for generating increased torque to rotate the drum member canted end sections.

Furthermore, the larger gear teeth are more resistant to the stresses exerted on the cutter drum member in the mining of hard material. This feature is particularly advantageous in reducing delays due to failure of the drum member drive components when mining hard material. Consequently, the initial cost of complex internal gearing arrangements is avoided as are the costs of maintenance and replacement parts.

According to the provisions of the patent statutes I have explained the principle, preferred construction and mode of operation of my invention and have illustrated and described what I now consider to represents its best embodiments. However, it should be understood that, within the scope of the appended claims, the invention may be practiced otherwise than as specifically illustrated and described.

I claim:

1. A continuous mining machine comprising, an elongated body portion mounted on propelling means, a drum member rotatably mounted forwardly of said body portion, said drum member having cutting elements extending therefrom, said drum member having an intermediate section and a pair of end sections, said end sections extending angularly to said intermediate section so that certain of said cutting elements mounted on said drum member overlap along the front of said drum member to provide a continuous cutting pattern along the front of said drum member, said drum member intermediate section and at least one of said pair of drum member end sections forming an opening therebetween, input drive means extending through said opening for rotating said drum member intermediate section, said drum member intermediate section and at least one of said pair of end sections each having a convexly shaped external surface, external meshing gear means nonrotatably secured to said convexly shaped external surfaces of said drum member intermediate section and of said pair of drum member end sections respectively for transmitting rotation of said input drive means from said drum member intermediate section to one of said pair of end sections, and said external meshing gear means being selectively spaced on said convexly shaped external surfaces to provide portions of said convexly shaped external surfaces between said external meshing gear means for urging the movement of dislodged material away from said convexly shaped external surfaces upon rotation of said drum member.

2. A continuous mining machine as set forth in claim 1 which includes, passageway means formed between said meshing gear means for directing flow of material dislodged by said cutting elements between said meshing gear means to ensure the continuous transmission of rotation to at least one of said pair of drum member end sections.

3. A continuous mining machine as set forth in claim 1 which includes, a plurality of passageways formed by said meshing gear means and said convexly shaped external surfaces of said drum member intermediate section and at least one of said pair of end sections, and said passageways being operable to facilitate movement of dislodged material between said meshing gear means during the continuous mining operation to prevent dislodged material from accumulating between said meshing gear means.

4. A continuous mining machine as set forth in claim 1 which includes, said cutting elements extending from said convexly shaped external surfaces of the adjacent end portions of said drum member intermediate section and said pair of drum member end sections in overlapping arrangement along the front of said drum member to dislodge material in front of the adjacent end sections of said drum member intermediate section and said pair of drum member end sections, and said cutting elements being positioned in staggered relation with respect to said meshing gear means to project forwardly thereof and provide a continuous cutting pattern opposite of said meshing gear means.

5. A continuous mining machine as set forth in claim 1 in which, said meshing gear means includes a first set of gears and a second set of gears, said first set of gears including a plurality of individual gear teeth secured to the end of said convexly shaped external surface of said drum member intermediate section adjacent at least one of said pair of drum member end sections, said gear teeth of said first set of gears being positioned in spaced relation around the periphery of said drum member intermediate section to form passageways between said gear teeth on said convexly shaped external surface of said drum member intermediate section, said second set of gears including a plurality of individual gear teeth secured to at least one of said pair of drum member end sections adjacent one of the ends of said drum member intermediate section, said respective drum member sections being canted relative to each other so that certain of said gear teeth of said first set of gears are positioned closely adjacent to certain of said gear teeth of said second set of gears, said gear teeth of said second set being positioned in spaced relation around the periphery of said drum member end section opposite said passageways between said gear teeth of said first set of gears, and said adjacently positioned gear teeth of said first set and said second set extending in meshing relation so that rotation of said drum member intermediate section is transmitted to at least one of said pair of drum member end sections.

6. A continuous mining machine as set forth in claim 1 which includes, said drum member intermediate section and at least one of said pair of end sections each having a cylindrical configuration with an arcuate external surface, said meshing gear means including a first set and a second set of gear teeth secured to said arcuate external surface of said drum member intermediate section and at least one of said pair of drum member end sections respectively, said gear teeth being positioned in spaced relation on said arcuate external surfaces of said respective drum member sections to form longitudinal passageways between said gear teeth, said longitudinal passageways having a width substantially equal to the width of said respective gear teeth, and said longitudinal passageways extending upwardly from said arcuate external surfaces of said respective drum member sections to facilitate the flow of dislodged material over said arcuate external surfaces between said gear teeth to prevent the accumulation of dislodged material between said gear teeth.

7. A continuous mining machine as set forth in claim 1 which includes, said meshing gear means including a plurality of gear teeth being welded to said convexly shaped external surfaces of said respective drum member sections and positioned in meshing relation so that rotation of said drum member intermediate section is transmitted to said respective end section, said gear teeth being positioned in spaced relation on said respective drum member sections with said convexly shaped external surfaces separating adjacent gear teeth, and said convexly shaped external surfaces between adjacent gear teeth being operable to promote the flow of dislodged material between said gear teeth and outwardly from the external surface of said respective drum member sections so that the spaces between said gear teeth remain free of dislodged material and rotation is continuously transmitted from said drum member intermediate section to said respective end section.

8. A continuous mining machine as set forth in claim 1 which includes, said drum member intermediate section and said pair of end sections each having an outer cylindrical surface, said meshing gear means being secured externally to said outer cylindrical surface of said drum member intermediate section and both of said pair of end sections, and said drum member intermediate section being rotated by said input drive means so that said meshing gear means transmits rotation simultaneously from said drum member intermediate section to rotate each of said drum member end sections in the direction of rotation of said drum member intermediate section and thereby rotate said drum member to dislodge solid material from a mine face the entire length of said drum member.

* * * * *